US006833187B2

(12) United States Patent
Luo et al.

(10) Patent No.: US 6,833,187 B2
(45) Date of Patent: Dec. 21, 2004

(54) UNBLEACHED PULP FOR LYOCELL PRODUCTS

(75) Inventors: Mengkui Luo, Tacoma, WA (US); Amar Neogi, Kenmore, WA (US)

(73) Assignee: Weyerhaeuser Company, Federal Way, WA (US)

( * ) Notice: Subject to any disclaimer, the term of this patent is extended or adjusted under 35 U.S.C. 154(b) by 9 days.

(21) Appl. No.: 10/417,667

(22) Filed: Apr. 16, 2003

(65) Prior Publication Data

US 2004/0209078 A1 Oct. 21, 2004

(51) Int. Cl.[7] ..... D02G 3/00

(52) U.S. Cl. ..... 428/359; 428/393; 162/70; 162/72; 162/91; 162/100

(58) Field of Search ..... 428/359, 362, 428/364, 393, 351; 162/72, 91, 100, 141, 142, 150, 157.1, 157.6

(56) References Cited

U.S. PATENT DOCUMENTS

| | | | | |
|---|---|---|---|---|
| 2,179,181 | A | 11/1939 | Graenacher et al. | |
| 3,447,939 | A | 6/1969 | Johnson | |
| 3,508,941 | A | 4/1970 | Johnson | |
| 3,919,041 | A | * 11/1975 | Wilder | 162/25 |
| 4,142,913 | A | 3/1979 | McCorsley, III et al. | |
| 4,144,080 | A | 3/1979 | McCorsley, III | |
| 4,145,532 | A | 3/1979 | Franks et al. | |
| 4,196,282 | A | 4/1980 | Franks et al. | |
| 4,211,574 | A | 7/1980 | McCorsley, III et al. | |
| 4,246,221 | A | 1/1981 | McCorsley, III | |
| 4,851,522 | A | 7/1989 | Chanzy et al. | |
| 5,277,857 | A | 1/1994 | Nicholson et al. | |
| 5,330,567 | A | 7/1994 | Zikeli et al. | |
| 5,401,447 | A | 3/1995 | Matsui et al. | |
| 5,409,532 | A | 4/1995 | Astegger et al. | |
| 5,534,113 | A | 7/1996 | Quigley et al. | |
| 5,599,366 | A | 2/1997 | Hassenboehler, Jr. et al. | |
| 5,683,794 | A | 11/1997 | Wadsworth et al. | |
| 5,747,394 | A | 5/1998 | Hassenboehler, Jr. et al. | |
| 5,985,097 | A | 11/1999 | Samuelsson | |
| 6,042,769 | A | 3/2000 | Gannon et al. | |
| 6,183,865 | B1 | * 2/2001 | Yabuki et al. | 428/393 |
| 6,197,230 | B1 | 3/2001 | Pierre et al. | |
| 6,210,801 | B1 | 4/2001 | Luo et al. | |
| 6,221,487 | B1 | * 4/2001 | Luo et al. | 428/364 |
| 6,235,392 | B1 | 5/2001 | Luo et al. | |
| 6,306,334 | B1 | * 10/2001 | Luo et al. | 264/561 |
| 6,331,354 | B1 | * 12/2001 | Sealey et al. | 428/393 |
| 6,440,523 | B1 | * 8/2002 | Sealey et al. | 428/93 |
| 6,440,547 | B1 | * 8/2002 | Luo et al. | 428/292.7 |
| 6,444,314 | B1 | * 9/2002 | Luo et al. | 428/393 |
| 6,471,727 | B2 | * 10/2002 | Luo et al. | 8/116.1 |
| 6,491,788 | B2 | * 12/2002 | Sealey et al. | 162/65 |
| 6,514,613 | B2 | * 2/2003 | Luo et al. | 428/393 |
| 6,527,987 | B1 | * 3/2003 | Yabuki et al. | 264/28 |

(List continued on next page.)

FOREIGN PATENT DOCUMENTS

| | | |
|---|---|---|
| FR | 2 735 794 A1 | 6/1995 |
| GB | 1144048 | 3/1969 |
| WO | WO 86/05526 A1 | 9/1986 |
| WO | WO 98/07911 | 2/1998 |
| WO | WO 98/22642 A1 | 5/1998 |
| WO | WO 99/16960 A1 | 4/1999 |
| WO | WO 02/086206 A1 * | 10/2002 |

*Primary Examiner*—Cynthia Kelly
*Assistant Examiner*—J. M. Gray
(74) *Attorney, Agent, or Firm*—Christensen O'Connor Johnson Kindness PLLC

(57) ABSTRACT

In accordance with the present invention, lyocell products can be made with unbleached pulps resulting in products with high amounts of hemicellulose and high amounts of lignin as compared to conventional lyocell products. The lyocell products of the present invention are advantageously less expensive to produce but retain the desirable strength of conventional lyocell products.

1 Claim, 9 Drawing Sheets

U.S. PATENT DOCUMENTS 6,528,163 B2 * 3/2003 Sealey et al. ..... 428/393
6,605,350 B1 * 8/2003 Sealey et al. ..... 428/393
2001/0028955 A1 * 10/2001 Luo et al. ..... 428/393
2002/0030382 A1 * 3/2002 Hasselgruber ..... 296/118
2002/0034638 A1 * 3/2002 Sealey et al. ..... 428/375
2002/0036070 A1 * 3/2002 Luo et al. ..... 162/100
2002/0037407 A1 * 3/2002 Luo et al. ..... 428/364
2002/0041961 A1 * 4/2002 Sealey et al. ..... 428/375
2002/0064654 A1 * 5/2002 Luo et al. ..... 428/364
2002/0076556 A1 * 6/2002 Luo et al. ..... 428/393
2002/0081428 A1 * 6/2002 Luo et al. ..... 428/364
2002/0088572 A1 * 7/2002 Sealey et al. ..... 162/65
2002/0155292 A1 * 10/2002 Sealey et al. ..... 428/375
2003/0025251 A1 * 2/2003 Sealey et al. ..... 264/561
2003/0025252 A1 * 2/2003 Sealey et al. ..... 264/561

* cited by examiner

UNBLEACHED PULP FOR LYOCELL PRODUCTS

FIELD OF THE INVENTION

The present invention is directed to products made from unbleached pulps, the process used to make such products and the processes used to make cellulose solutions from unbleached pulp for spinning into lyocell products.

BACKGROUND OF THE INVENTION

Cellulose is a polymer of D-glucose and is a structural component of plant cell walls. Cellulose is especially abundant in tree trunks from which it is extracted, converted into pulp, and thereafter utilized to manufacture a variety of products. Rayon is the name given to a fibrous form of regenerated cellulose that is extensively used in the textile industry to manufacture articles of clothing. For over a century, strong fibers of rayon have been produced by the viscose and cuprammonium processes. The latter process was first patented in 1890 and the viscose process two years later. In the viscose process, cellulose is first steeped in a mercerizing strength caustic soda solution to form an alkali cellulose. The cellulose is then reacted with carbon disulfide to form cellulose xanthate, which is then dissolved in a dilute caustic soda solution. After filtration and deaeration, the xanthate solution is extruded from submerged spinnerets into a regenerating bath of sulfuric acid, sodium sulfate, zinc sulfate, and glucose to form continuous filaments. The resulting viscose rayon is presently used in textiles and was formerly widely used for reinforcing rubber articles such as tires and drive belts.

Cellulose is also soluble in a solution of ammonia copper oxide. This property forms the basis for the production of cuprammonium rayon. The cellulose solution is forced through submerged spinnerets into a solution of 5% caustic soda or dilute sulfuric acid to form the fibers, which are then decoppered and washed. Cuprammonium rayon is available in fibers of very low deniers and is used almost exclusively in textiles.

The foregoing processes for preparing rayon both require that the cellulose be chemically derivatized or complexed in order to render it soluble and therefore capable of being spun into fibers. In the viscose process, the cellulose is derivatized, while in the cuprammonium rayon process, the cellulose is complexed. In either process, the derivatized or complexed cellulose must be regenerated and the reagents used to solubilize it must be removed. The derivatization and regeneration steps in the production of rayon significantly add to the cost of this form of cellulose fiber. Consequently, in recent years attempts have been made to identify solvents that are capable of dissolving underivatized cellulose to form a dope of cellulose from which fibers can be spun.

One class of organic solvents useful for dissolving cellulose are the amine N-oxides, in particular the tertiary amine N-oxides. For example, Graenacher, in U.S. Pat. No. 2,179,181, discloses a group of amine oxide materials suitable as solvents. Johnson, in U.S. Pat. No. 3,447,939, describes the use of anhydrous N-methylmorpholine-N-oxide (NMMO) and other amine N-oxides as solvents for cellulose and many other natural and synthetic polymers. Franks et al., in U.S. Pat. Nos. 4,145,532 and 4,196,282, deal with the difficulties of dissolving cellulose in amine oxide solvents and of achieving higher concentrations of cellulose.

Lyocell is an accepted generic term for a cellulose fiber precipitated from an organic solution in which no substitution of hydroxyl groups takes place and no chemical intermediates are formed. Several manufacturers presently produce lyocell fibers, principally for use in the textile industry. For example, Acordis, Ltd. presently manufactures and sells a lyocell fiber called Tencel® fiber.

Currently available lyocell fibers are produced from wood pulps that have been extensively processed to remove non-cellulose components, especially hemicellulose, and lignin. These highly processed pulps are referred to as high alpha (or high $\alpha$) pulps, where the term alpha (or $\alpha$) refers to the percentage of cellulose. Thus, a high alpha pulp contains a high percentage of cellulose, and a correspondingly low percentage of other components, especially hemicellulose and lignin. The processing required to generate a high alpha, low lignin pulp significantly adds to the cost of lyocell fibers and products manufactured therefrom.

Furthermore, the wood chips are pretreated with an acid before the pulping stage, since it is not possible to obtain acceptable high alpha pulps for lyocell products otherwise through the Kraft process. A significant amount of material, primarily hemicellulose on the order of 10% or greater, of the original wood substance is solubilized in this acid phase pretreatment. Thus process yields are significantly diminished. Omitting the acid phase pretreatment will result in a high hemicellulose pulp. The disadvantage of conventional high alpha pulps is the reduction of yield by eliminating hemicelluloses from the pulp.

Conventional high alpha pulps are also bleached. Bleaching refers to the removal of lignin in a process subsequent to the pulping process. Removing lignin also reduces the overall yield of the original wood material.

In view of the expense of producing lyocell products from high alpha pulps that have small amounts of hemicellulose and lignin, it would be desirable to have alternatives to high alpha, low lignin pulps for making lyocell products.

Thus there is a need for relatively inexpensive, low alpha, high yield, high hemicellulose, and high lignin pulps that are useful for making lyocell products.

In U.S. Pat. No. 6,210,801, fully incorporated herein by reference in its entirety, high hemicellulose containing pulp is described that is useful for lyocell products. The pulp is made by reducing the viscosity of the cellulose without substantially reducing the hemicellulose content, followed by reducing the copper number.

While the methods described in the '801 patent are effective at reducing the viscosity of cellulose without substantially decreasing the hemicellulose content, a further need existed for a process that did not require a separate copper number reducing step, and that was readily adaptable to pulp mills that have oxygen reactors. In U.S. Pat. No. 6,331,354, fully incorporated herein by reference in its entirety, a high hemicellulose, low viscosity pulp is described that is useful for making lyocell products that does not require an additional copper number reducing step. The pulp is made from an alkaline pulp by treating the alkaline pulp with an oxidizing agent in a medium to high consistency oxygen reactor to reduce the viscosity of the cellulose, without substantially reducing the hemicellulose or increasing the copper number of the pulp.

Further efforts to reduce the cost of making lyocell products are described in U.S. application Ser. No. 09/842,274, now U.S. Pat. No. 6,605,350 fully incorporated herein by reference in its entirety. In the '274 application, the pulps are made from sawdust and other low length fiber wood. These pulps are high in hemicellulose and low in viscosity, and are composed of short fibers suitable for producing lyocell products.

However, until now, all of the prior art dissolving pulps for producing lyocell products are low in lignin content. It would be advantageous to develop a high lignin pulp that is useful for making lyocell products as an alternative to the highly refined low yield high alpha pulps.

SUMMARY OF THE INVENTION

In accordance with the present invention, lyocell products can be made with unbleached pulps resulting in products with high amounts of hemicellulose and high amounts of lignin as compared to conventional lyocell products. The lyocell products of the present invention are advantageously less expensive to produce but retain the desirable strength of conventional lyocell products.

One embodiment of the invention provides a high hemicellulose, high lignin lyocell fiber. The fiber has a dry tenacity of at least 46 cN/tex at a gauge length of about 10 mm and a dry tenacity of at least 30 cN/tex at a gauge length of about 30 mm. The hemicellulose content of the fiber is at least 7% and the lignin content of the fiber is at least 2% measured as Klason lignin.

In another embodiment of the invention, a lyocell fiber has an average diameter of from 9 to 16 microns; however, other embodiments of fibers have an average diameter of from 12 to 14 microns.

In another embodiment of the invention, a method for making a lyocell product is described. The method includes modifying a pulp having at least 7% hemicellulose and at least 2% Klason lignin by acid hydrolysis to lower the average degree of polymerization of the cellulose in the pulp, wherein greater than 95% of cellulose has an average D.P. from greater than about 400 to about 1100. The method also includes dissolving the unbleached pulp in a solvent to provide a cellulose solution, and spinning the cellulose solution into a lyocell product. The method uses meltblowing, centrifugal spinning, spun-bonding, or dry-jet wet spinning techniques. Fibers, films, and self-bonded nonwoven webs from unbleached pulps can be produced according to the methods of the invention.

In another embodiment of the invention, a pulp is provided. The pulp has at least 7% hemicellulose and at least 2% Klason lignin. The pulp also has cellulose, wherein greater than 95% of the cellulose has an average D.P. of from greater than about 400 to about 1100.

In another embodiment of the invention, a meltblowing method for making a lyocell product is provided. The method includes extruding a cellulose solution of unbleached pulp through a plurality of apertures to produce continuous cellulose filaments. The method includes stretching the filaments with air.

According to the present invention, an unbleached pulp, having been modified to reduce its average degree of polymerization of cellulose, results in substantial increases in yield. The high amounts of hemicellulose and lignin contribute to this greater improvement in overall yield. This advantage, along with numerous related advantages, makes the lyocell product of this invention more desirable in comparison with previous technology.

DETAILED DESCRIPTION OF THE PREFERRED EMBODIMENT

Figure 1:
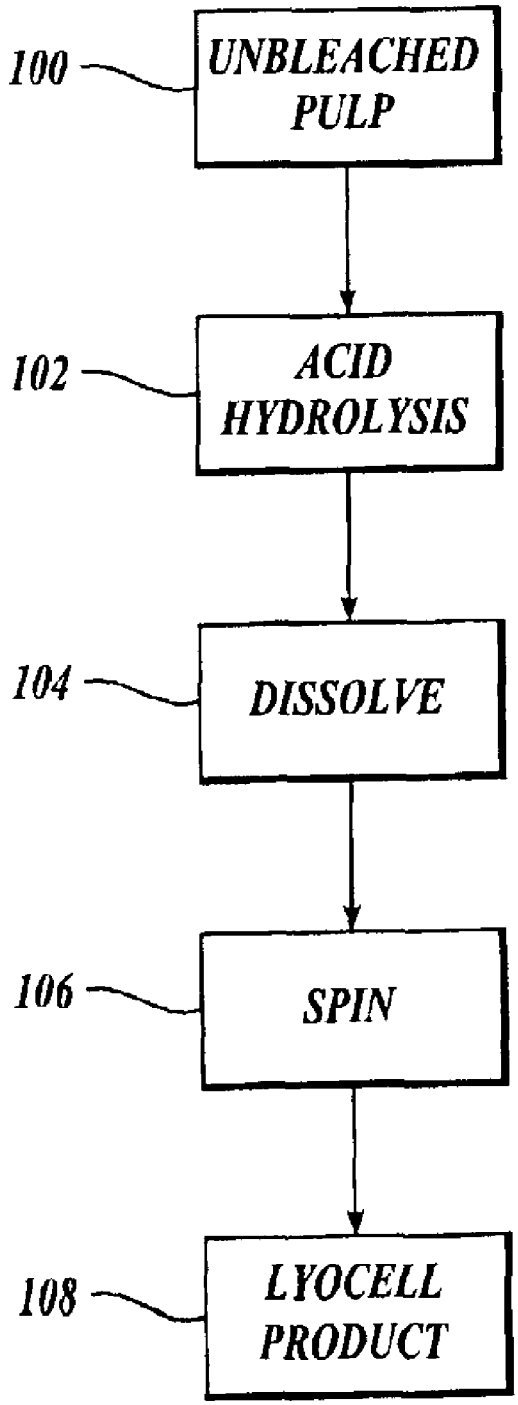
FIG. 1 shows a block diagram of one embodiment of a method according to the present invention.

Referring to FIG. 1, one embodiment of a method of making lyocell products from high hemicellulose, high lignin pulp is illustrated. In block 100, Kraft pulp or any other suitable alkaline pulp is obtained from any adequate supplier, such as from the Weyerhaeuser Company. In Kraft and alkaline pulping, the active chemical compounds are NaOH and $Na_2S$. Other chemicals may be added to influence or impart desirable effects during the pulping process. These additional chemicals are well known to those skilled in the art. According to the present process, the wood does not undergo an acid phase pre-treatment step as has been the conventional practice of making dissolving pulp for lyocell products. Rather, the wood is pulped according to conventional methods. The Kraft or alkaline pulping process usually ends with washing the brownstock pulp. Alternatively, one embodiment of the invention can omit the pulping step, block 100, in favor of obtaining a suitable unbleached pulp from suppliers of unbleached pulp. One suitable supplier is the Weyerhaeuser Company.

Conventional dissolving pulps for lyocell products are processed through a sequence of bleaching towers to reduce the lignin content. However, in the present invention, the bleaching stages are omitted. In step 102, the unbleached pulp is modified to reduce its viscosity. Reducing the viscosity of the pulp increases its ability to dissolve. The viscosity of the unbleached pulp is reduced so that the average D.P. of 95% of the cellulose is modified to greater than 400 to about 1100. Unbleached pulps are made into lyocell products by first dissolving the unbleached pulp in an amine oxide and then spinning the solution into filaments followed by regeneration of the filaments. One method for modifying the viscosity of unbleached pulp is by acid hydrolysis. Any acid may be utilized, such as hydrochloric acid or sulfuric acid. The acid may be utilized in the form of a liquid, or may be formed from a gas, such as by dissolving hydrogen chloride gas in an aqueous medium. Another method is by swelling the cellulose in an alkaline solution followed by alkali removal and treatment with a cellulolytic enzyme, preferably an endogluconase enzyme. Alternatively, steam explosion can be utilized. Further, any combination of methods for viscosity reduction can be utilized, such as steam explosion combined with acid hydrolysis. An advantage of utilizing acid hydrolysis to reduce viscosity is that transition metal contaminants in the pulp are removed by the acid treatment. If an acid treatment step is not utilized, then an alternative method of removing transition metals from the pulp can be utilized, such as treatment of the pulp with a chelating agent. Other equally suitable methods for reducing the viscosity of unbleached pulps are described in the aforementioned U.S. Pat. Nos. 6,210,801 and 6,331,354, fully incorporated herein by reference in their entirety.

Unbleached pulps having their viscosity modified can be spun into lyocell products. Modified unbleached pulps are high in hemicellulose and high in lignin and can readily dissolve to provide cellulose solutions that can be spun into lyocell products.

Methods for measuring pulp viscosity are well known in the art, such as TAPPI T230. Methods used for measuring hemicellulose include, for example, a sugar content assay based on TAPPI standard T29 hm-85. Methods for expressing lignin content are also well known. The amount of lignin can be expressed as Kappa number, Klason lignin, or K (permanganate) number.

Following the pulping process, block 100, or the viscosity reduction process, block 102, the brownstock pulp can be made into a form which is suitable to be transported or stored, or otherwise transformed into a more convenient form for handling. A pulp may be provided in a roll, sheet, or bale, for example.

Referring still to FIG. 1, to make lyocell products from the modified, unbleached pulp, the pulp can be washed in water and transferred to a bath of organic solvent for dissolution, preferably a tertiary amine oxide, block 102. Representative examples of amine oxide solvents useful in the practice of the present invention are set forth in U.S. Pat. No. 5,409,532, fully incorporated herein by reference in its entirety. The preferred amine oxide solvent is N-methyl-morpholine-N-oxide (NMMO). Other representative examples of solvents useful in the practice of the present invention include dimethylsulfoxide (D.M.S.O.), dimethylacetamide (D.M.A.C.), dimethylformamide (D.M.F.) and caprolactan derivatives. The pulp is dissolved in amine oxide solvent by any known method such as set forth in U.S. Pat. Nos. 5,534,113; 5,330,567; and 4,246,221, fully incorporated herein by reference in their entirety. The pulp solution is called "dope." The dope can be used to manufacture lyocell fibers, films, and nonwovens or other products by a variety of techniques, generally referred to as spinning, block 106. Spinning includes methods such as meltblowing, spunbonding, centrifugal spinning, dry-jet wet, and other equally suitable methods. Some of these techniques are more fully described in U.S. Pat. Nos. 6,235,392; 6,306,334; 6,210,802; and 6,331,354, fully incorporated herein by reference in their entirety. Examples of techniques for making films are set forth in U.S. Pat. Nos. 5,401,447; and 5,277,857, fully incorporated herein by reference in their entirety. Spinning results in a lyocell product, block 108, of the present invention, wherein the lyocell product has a high hemicellulose content, and a high lignin content, but is suitable to use as alternatives to conventional lyocell products, including fibers, films, or nonwovens, for example.

Figure 2:
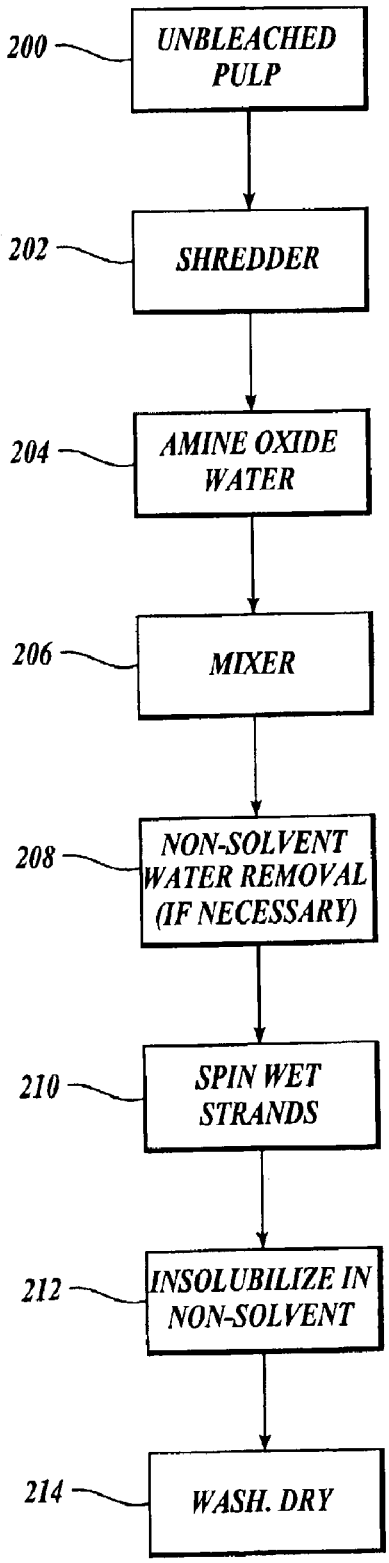
FIG. 2 shows a block diagram of one embodiment of a method according to the present invention.

One embodiment of a method for making lyocell fibers from dope derived from modified unbleached pulp having high hemicellulose and high lignin involves extruding the dope through a die to form a plurality of filaments, followed by washing the filaments to remove the solvent, and then drying the lyocell filaments. FIG. 2 shows a block diagram of one embodiment of a method for forming lyocell fibers from a modified, unbleached pulp having high hemicellulose and high lignin content according to the present invention. Starting with high hemicellulose, high lignin pulp in block 200, the pulp is physically broken down, for example, by a shredder in block 202. The pulp is dissolved with an amine oxide-water mixture to form a dope, block 204. The pulp is wet with a nonsolvent mixture of about 40% NMMO and 60% water. The mixture can be mixed in a double arm sigma blade mixer and sufficient water distilled off to leave about 12–14% based on NMMO so that a cellulose solution is formed, blocks 206 and 208. Alternatively, NMMO of appropriate water content may be used to eliminate the need for the water removal step 208. This is a convenient way to prepare spinning dopes in the laboratory where commercially available NMMO of about 40–60% concentration can be mixed with laboratory reagent NMMO having only about 3% water to produce a cellulose solvent having 7–15% water. Moisture normally present in the pulp should be accounted for in adjusting the water present in the solvent. Reference is made to articles by Chanzy, H., and A. Peguy, *Journal of Polymer Science, Polymer Physics Ed.* 18:1137–1144 (1980), and Navard, P., and J. M. Haudin, *British Polymer Journal*, December 1980, p. 174, for laboratory preparation of cellulose dopes in NMMO and water solvents.

The cellulose solution derived from the modified, unbleached pulp dope is forced through extrusion orifices in a process called spinning, block 210, to produce cellulose filaments that are then regenerated with a non-solvent, block 212. Finally, the lyocell filaments or fibers can be washed and dried, block 214. Filaments may also be aggregated into a nonwoven web before regeneration.

In meltblowing, the cellulose solution is forced from extrusion orifices into a turbulent airstream. Meltblowing produces continuous cellulose filaments and causes stretching of the filaments with the air. Where the fibers are produced by centrifugal spinning, the cellulose solution is fed to a rotating head and expelled through small orifices into air. The cellulose filaments are drawn or stretched by the resistance of the air caused by the rapidly rotating head. In meltblowing and centrifugal spinning, the latent filaments are regenerated in a bath or with sprayers. In other embodiments, conventional processes for forming lyocell fibers can be used which continuously mechanically pull the extruded filaments linearly downward into a regenerating bath through an air gap. The latter process is sometimes referred to as a "dry-jet wet" spinning process.

In the dry-jet wet spinning process, cellulose solution is extruded from a multiplicity of fine apertured spinnerets into an air gap. The filaments of cellulose dope are continuously mechanically drawn. They are then led into a non-solvent, usually water, to regenerate the cellulose. Examples of this process are described in McCorsley in U.S. Pat. Nos. 4,142,913; 4,144,080; 4,211,574; 4,246,221; and others. These patents are expressly incorporated herein by reference in their entirety.

More specifically, in meltblowing, a supply of dope is pumped through an extrusion head having a multiplicity of orifices. Compressed air or any other suitable gas is supplied to the extrusion head. Latent cellulose filaments are extruded from the orifices. These thin strands of cellulose solution are picked up by the high velocity gas stream exiting from the orifices and are stretched or elongated by the gas. The latent filament strands can be regenerated by passing between spray pipes that carry water or any other suitable regenerating liquid. Alternatively, the strands can pass into a regenerating bath. The regenerated filaments are then picked up by a rotating pickup roll where they accumulate until a sufficient amount of fiber has accumulated.

In centrifugal spinning, the cellulose solution is directed into a hollow cylinder or drum with a base and a multiplicity of small apertures in the sidewalls. As the cylinder rotates, cellulose solution is forced out horizontally through the apertures as thin cellulose filaments or strands. As these strands meet resistance from the surrounding air, they are drawn or stretched. The cellulose strands will fall by gravity or are gently forced downward by an air flow into a nonsolvent where they coagulate into individual oriented fibers.

Processes for meltblowing cellulose solutions are described in U.S. Pat. Nos. 6,235,392 and 6,306,334, incorporated herein by reference in their entirety. The centrifugal spinning method is described in U.S. Pat. No. 6,235,392.

In meltblowing, centrifugal spinning, and spun-bonding, as the cellulose filaments encounter resistance from the air, they will be drawn or stretched by contact with the air. The cellulose filaments will also undergo a reduction in diameter. The amount of stretching will depend on readily controllable factors such as orifice size, dope viscosity, cellulose concentration in the dope, air speed, nozzle diameter, spinning temperature, winder speed, bath temperature, etc. Meltblowing and centrifugal spinning can be used to produce nonwoven webs, as described in U.S. Pat. No. 6,235,392.

Figure 3:
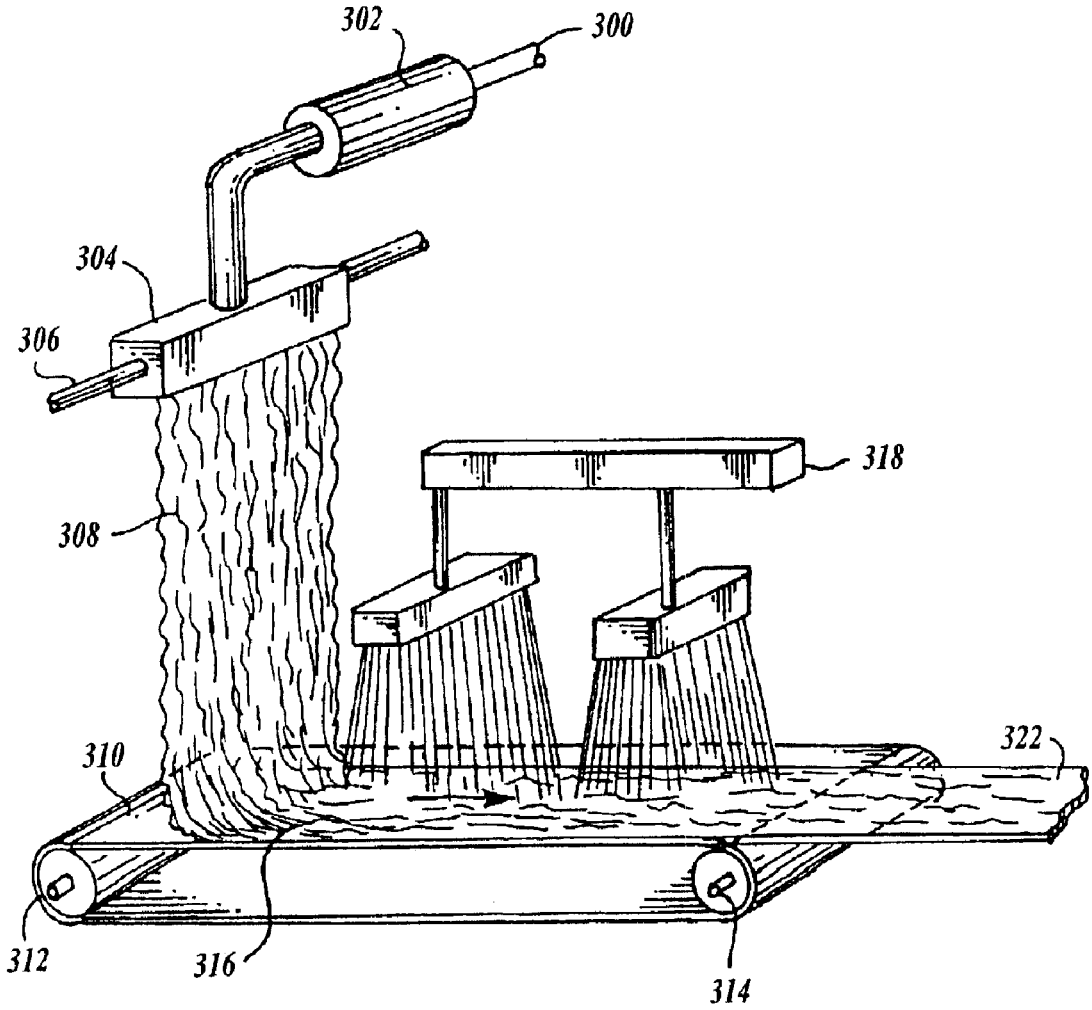
FIG. 3 shows an illustration of a system for carrying out the present invention.

One particularly useful embodiment of an apparatus for making a lyocell nonwoven web made from an aggregate of lyocell fibers is shown in U.S. Pat. No. 6,235,392. However, in the present invention, the cellulose material is provided from a modified unbleached pulp having high hemicellulose and high lignin. Referring to FIG. 3, a cellulose dope is pumped via line 300 to an extruder 302 and from there to an extrusion head 304. An air supply source 306 stretches the dope strands 308 as they descend from the extrusion head. Process parameters are preferably chosen so that the resulting cellulose fibers will be continuous rather than random shorter lengths. The fibers fall onto an endless moving foraminous belt 310 supported and driven by rollers 312 and 314. Here they form a latent nonwoven fabric mat 316. A top roller, not shown, may be used to press the fibers into tight contact and ensure bonding at the inter-fiber crossover points. As the mat 316 proceeds along its path while supported on belt 310, a regenerating solution, including water, is sprayed downward by sprayer 318. The regenerated product 322 is then removed from the end of the belt where it may be further processed, for example, by washing, and drying.

Figure 4:
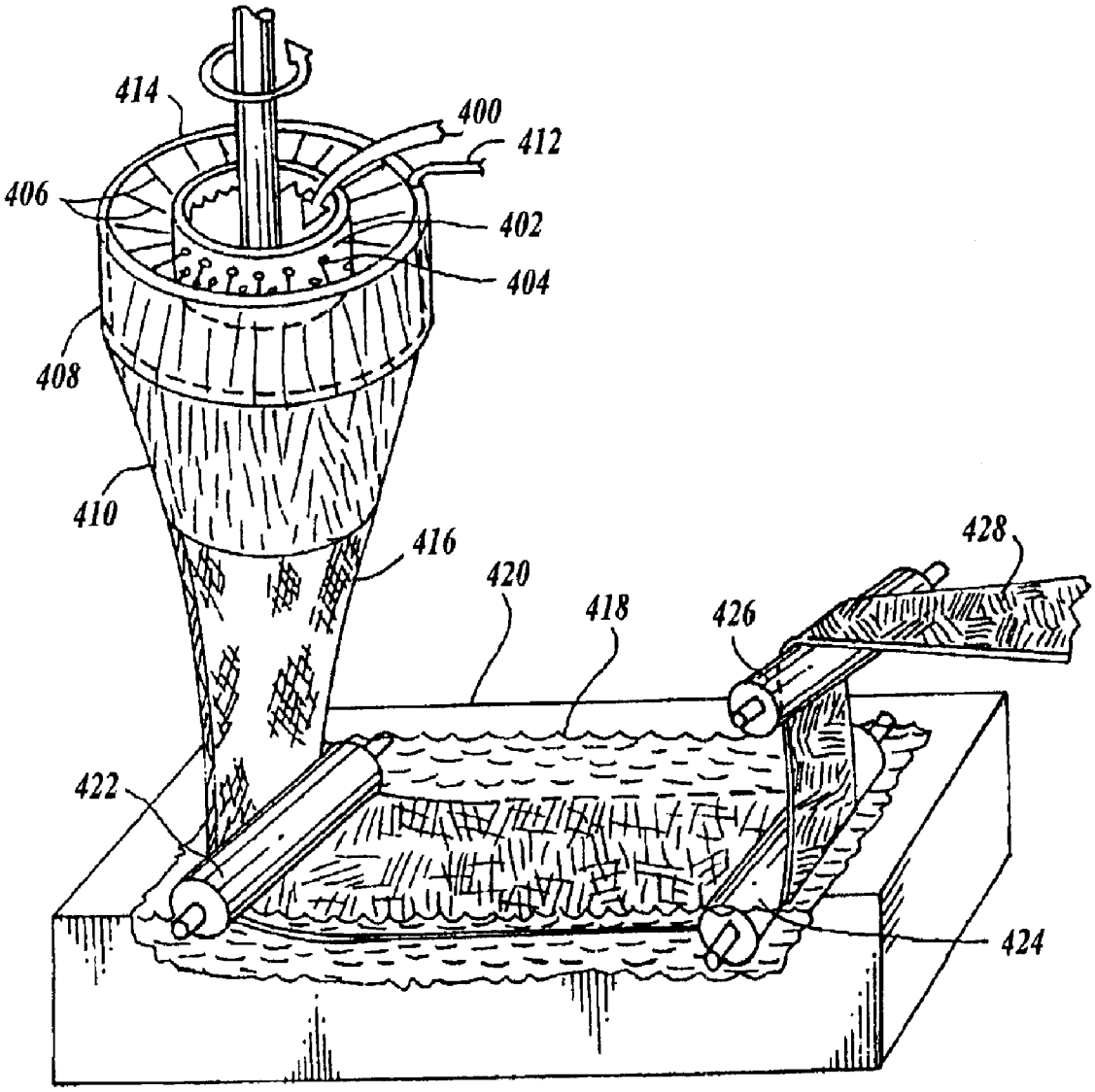
FIG. 4 shows an illustration of a system for carrying out the present invention.

FIG. 4 shows an alternative embodiment of an apparatus for making a lyocell self-bonded nonwoven web made from an aggregate of lyocell fibers using centrifugal spinning. Referring to FIG. 4, cellulose dope 400 is fed into a rapidly rotating drum 402 having a multiplicity of orifices 404 in the sidewalls. Latent fibers 406 are expelled through orifices 404 and drawn, or lengthened by air resistance and the inertia imparted by the rotating drum 402. They impinge on the inner sidewalls of a receiver surface 408 concentrically located around the drum. The receiver 408 may optionally have a frustroconical lower portion 410. A curtain or spray of regenerating solution, including water, supplied via line 412 flows downward from ring 414 located around the walls of the receiver 408 to partially coagulate the cellulose mat that impinges on the sidewalls of the receiver 408. Ring 414 may be located as shown in FIG. 4 or moved to a lower position if more time is needed for the latent fibers to self-bond into a nonwoven web. The partially coagulated nonwoven web 416 is pulled from the lower part 410 of the receiver into a coagulating bath 418 in container 420. As the web moves along its path, it is collapsed from a cylindrical configuration into a planar two-ply nonwoven structure. The web is held within the bath as it moves under rollers 422, 424. A take-out roller 426 removes the now fully coagulated 2-ply web 428 from the bath. Any or all of rollers 422, 424, or 426 may be driven. The web 428 is then continuously directed into a wash and/or bleaching operation, not shown, following which it is dried for storage. It may be split and opened into a single ply nonwoven, or maintained as a 2-ply material as desired.

Figure 5:
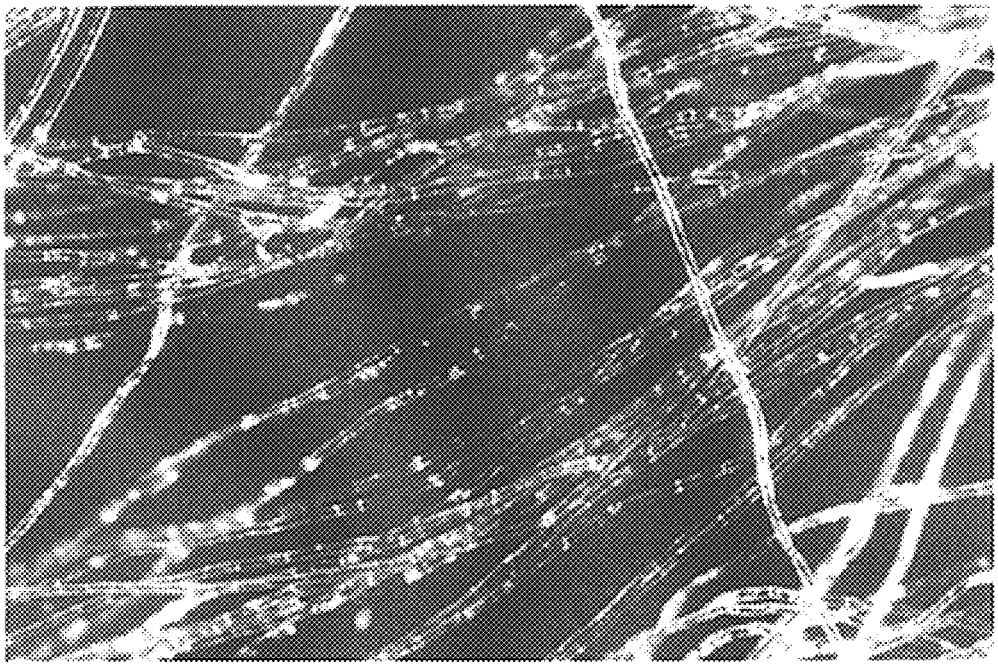
FIG. 5 is a scanning electron micrograph of commercial lyocell fibers produced by a dry-jet wet spinning method.
Figure 6:
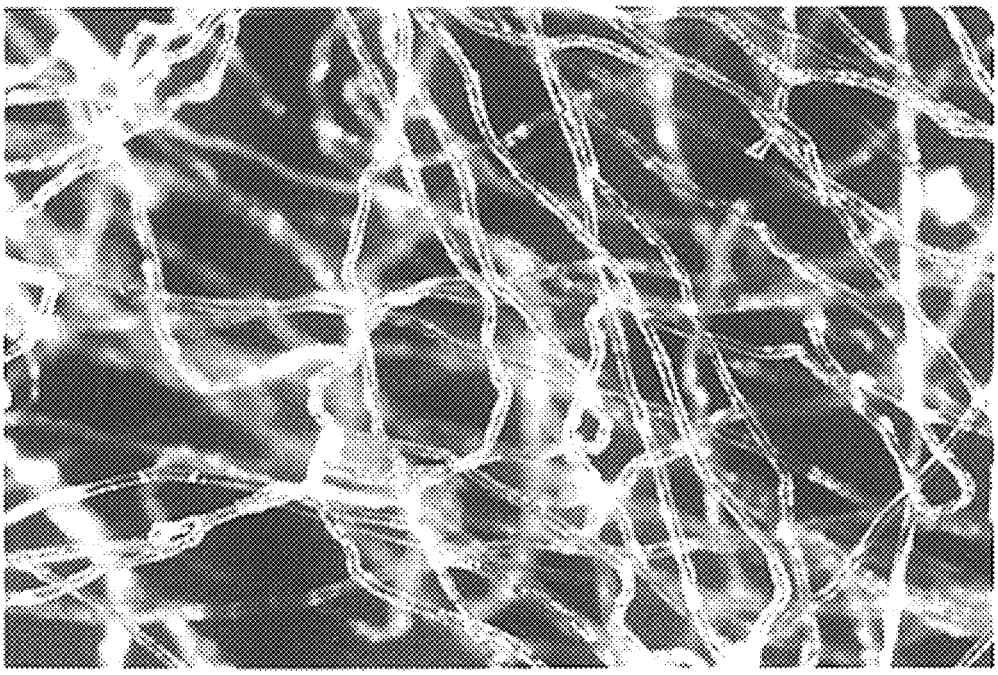
FIG. 6 is a scanning electron micrograph of commercial lyocell fibers produced by a dryjet wet spinning method.
Figure 7:
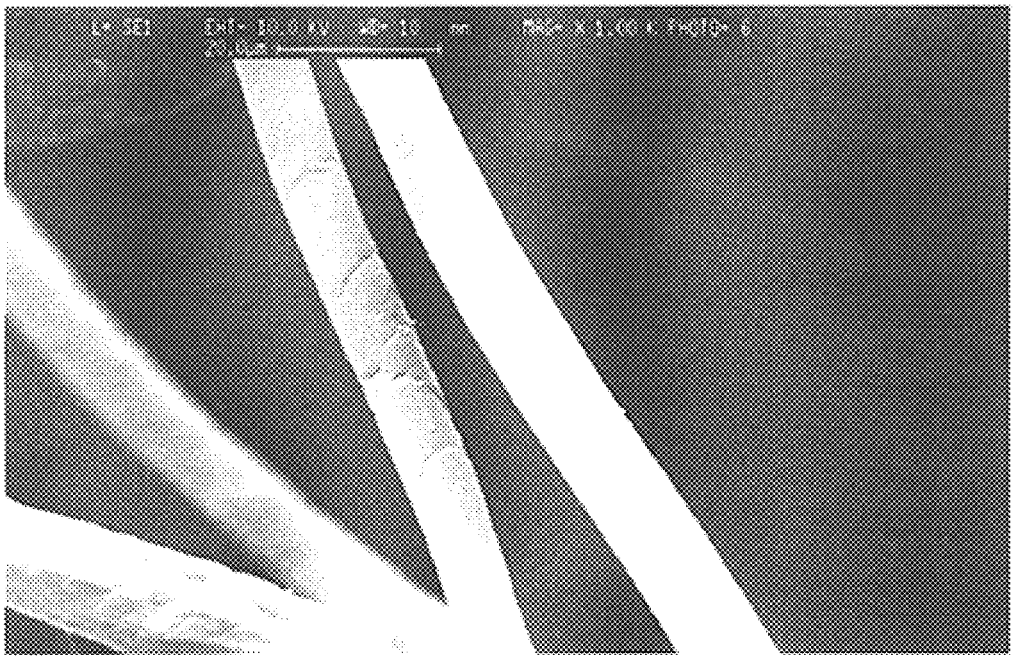
FIG. 7 is a scanning electron micrograph of a lyocell fiber produced from modified unbleached pulp according to the present invention.

As can be seen from FIGS. 5 and 6, the morphology of the meltblown lyocell fibers from the modified unbeached pulps have unique properties. The dry-jet wet lyocell fibers usually have smooth surfaces and a consistent cross-sectional diameter. The dry-jet wet lyocell fibers do not have crimps that are produced by the spinning method. Meltblown lyocell fibers regularly have pebbled surfaces. Meltblown lyocell fibers vary in cross-sectional diameter along the length of the fiber and have crimps due to the meltblowing process. The meltblown lyocell fibers have greater diameter variability along the fiber length and between fiber to fiber as compared with fibers produced from a dry-jet wet method. Many of the characterizing morphological features of meltblown lyocell fibers are described in U.S. Pat. No. 6,235,392.

Figure 8:
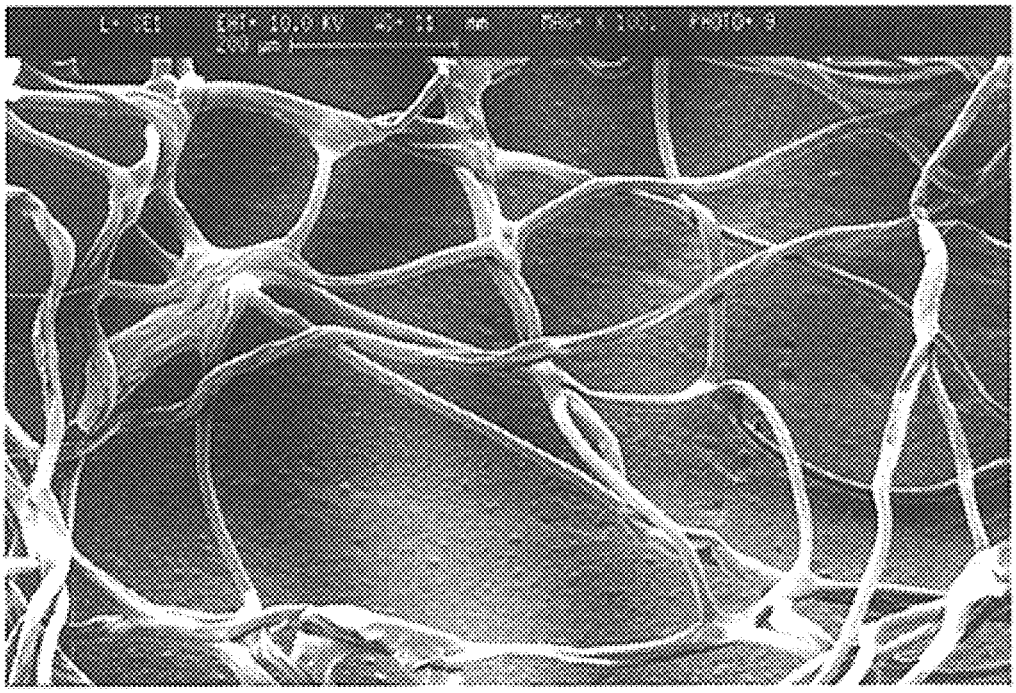
FIG. 8 is a scanning electron micrograph of a self-bonded lyocell nonwoven web made by a meltblown spinning method from modified unbleached pulp according to the present invention.
Figure 9:
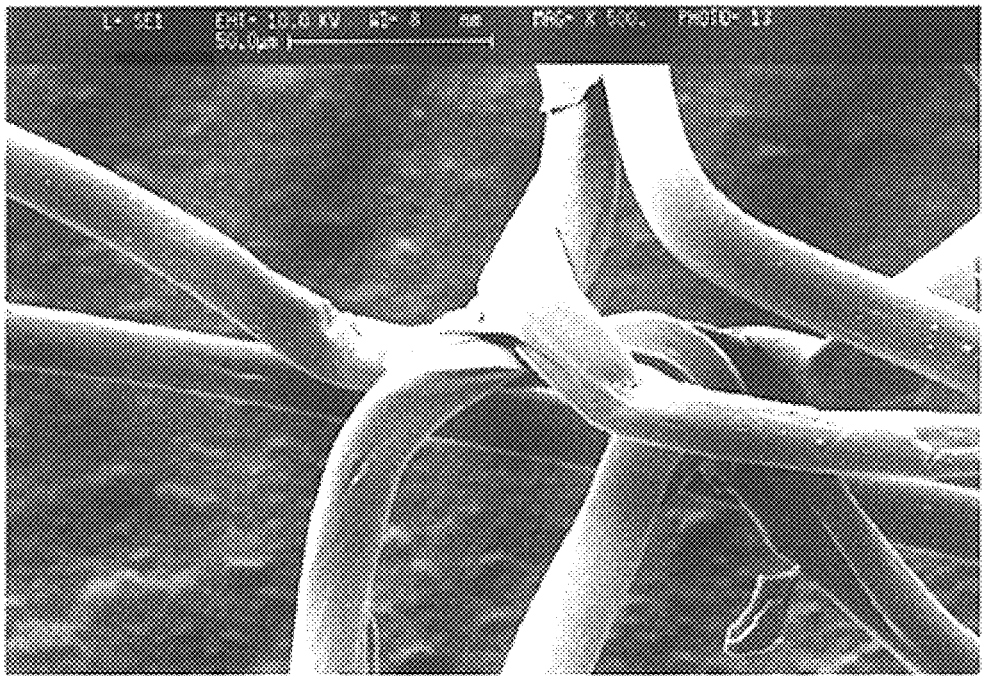
FIG. 9 is a scanning electron micrograph of a self-bonded lyocell nonwoven web made by a meltblown spinning method from modified unbleached pulp according to the present invention.
Figure 10:
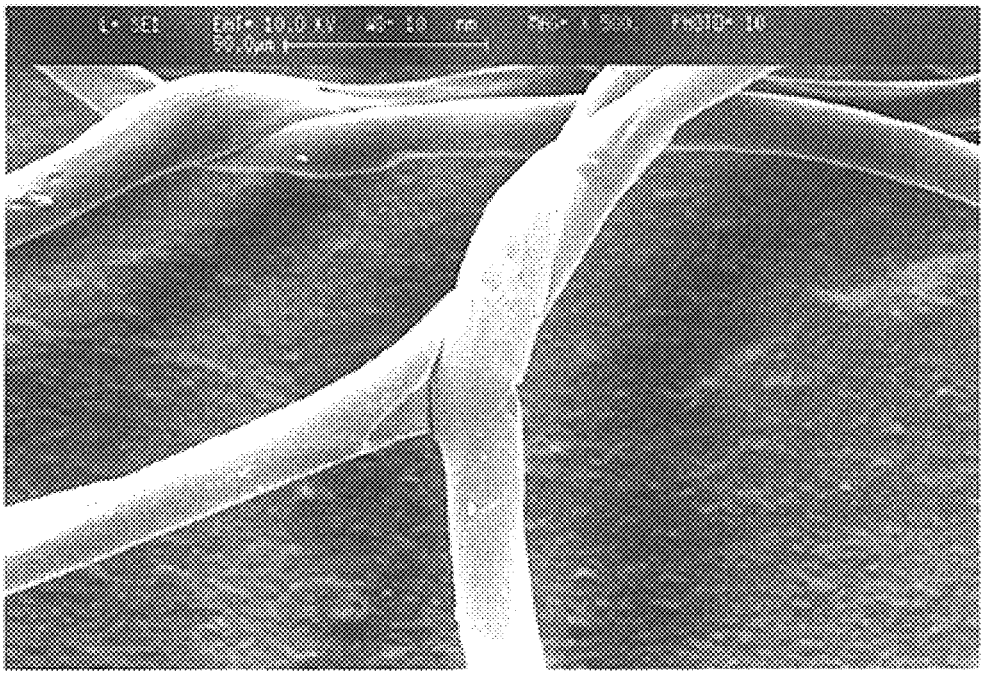
FIG. 10 is a scanning electron micrograph of a self-bonded lyocell nonwoven web made by a meltblown spinning method from modified unbleached pulp according to the present invention.

Microfibers can be produced by the meltblowing spinning process; however, self-bonded nonwoven webs using the meltblown process is also of great commercial interest. Self-bonded meltblown nonwoven webs made from modified unbleached pulp are produced. Referring now to FIGS. 8–10, some distinguishing features of the nonwoven webs made from meltblowing the modified unbleached Kraft pulp are shown. It is apparent that the fiber segments in the nonwoven web made from unbleached modified Kraft pulp have similar features as the meltblown lyocell fiber described in earlier patents. However, in the present application, the nonwoven webs are produced from modified unbleached pulps having high hemicellulose and high lignin content, and accordingly, have a lower brightness measurement. The morphological features of the fibers can have distinct advantages for particular applications. The lyocell fibers in the nonwoven web structure were regularly bonded at the cross points. The nonwoven web structure appears to be very porous. By adjusting the processing conditions, self-bonded nonwoven webs of different basis weights can be produced and the tensile properties of the nonwoven web structure can be optimized for specific applications. In FIGS. 9 and 10, the bonded areas are shown in great detail and more than two fibers are bonded together at one crossover point. This will impart additional strength to the nonwoven web structure.

Lyocell fibers produced by meltblowing, centrifugally spinning, or spun-bonding modified, unbleached cellulose pulps possess a natural crimp quite unlike that imparted by a conventional stuffer box. Crimp imparted by a stuffer box is relatively regular, has a relatively low amplitude, usually less than a 1 fiber diameter, and a short peak-to-peak period, normally not more than 2 or 3 fiber diameters. The fibers made according to the present invention have an irregular amplitude greater than 1 fiber diameter, usually much greater, and an irregular period exceeding about 5 fiber diameters, a characteristic of fibers having a curly or wavy appearance. The fiber diameter along the length of each individual fiber can vary, as well as the average fiber diameter between fibers. A quantifiable measurement of this variability is termed coefficient of variability. The fibers of the present invention have a range of diameters and tend to be somewhat curly giving them a natural crimp. This natural crimp is quite unlike the regular sinuous configuration obtained in a stuffer box. Both amplitude and period are irregular and are at least several fiber diameters in height and length. Most of the fibers are somewhat flattened and some show a significant amount of twist. The methods are useful in producing microfibers. In one embodiment, average fiber diameter varies from about 6 to 42 microns. In one embodiment, average fiber diameter is about 9 to 16 microns. In one other embodiment, average fiber diameter is about 12–14 microns.

Lyocell products, including fibers, films, and nonwovens made from modified unbleached pulp having high hemicellulose and high lignin content are high in tenacity regardless whether they are made from meltblowing, centrifugal spinning, spun-bonding, dry-jet wet or any other method. Modified, unbleached pulps having high hemicellulose and high lignin can also be made into microfibers having an average size of about 0.1 denier.

In one embodiment, a lyocell fiber was made from modified unbleached pulp having high hemicellulose, and high lignin. The lignin content of the fiber was at least 2% Klason lignin. The hemicellulose content of the fiber was at least about 7%. The lyocell fiber further contains cellulose, wherein greater than 95% of the cellulose has an average D.P. of from greater than 400 to 1100. The lyocell fiber has a dry tenacity of at least 46 cN/tex at a gauge length of about 10 mm or a dry tenacity of at least 30 cN/tex at a gauge length of about 30 mm. The average diameter of the fiber can range from about 6 to about 19 microns using a dry-jet wet process to about 2 to about 46 microns using a meltblowing process. The median appears to lie between about 9 to about 16 microns, or between about 12 to about 14 microns.

Figure 11:
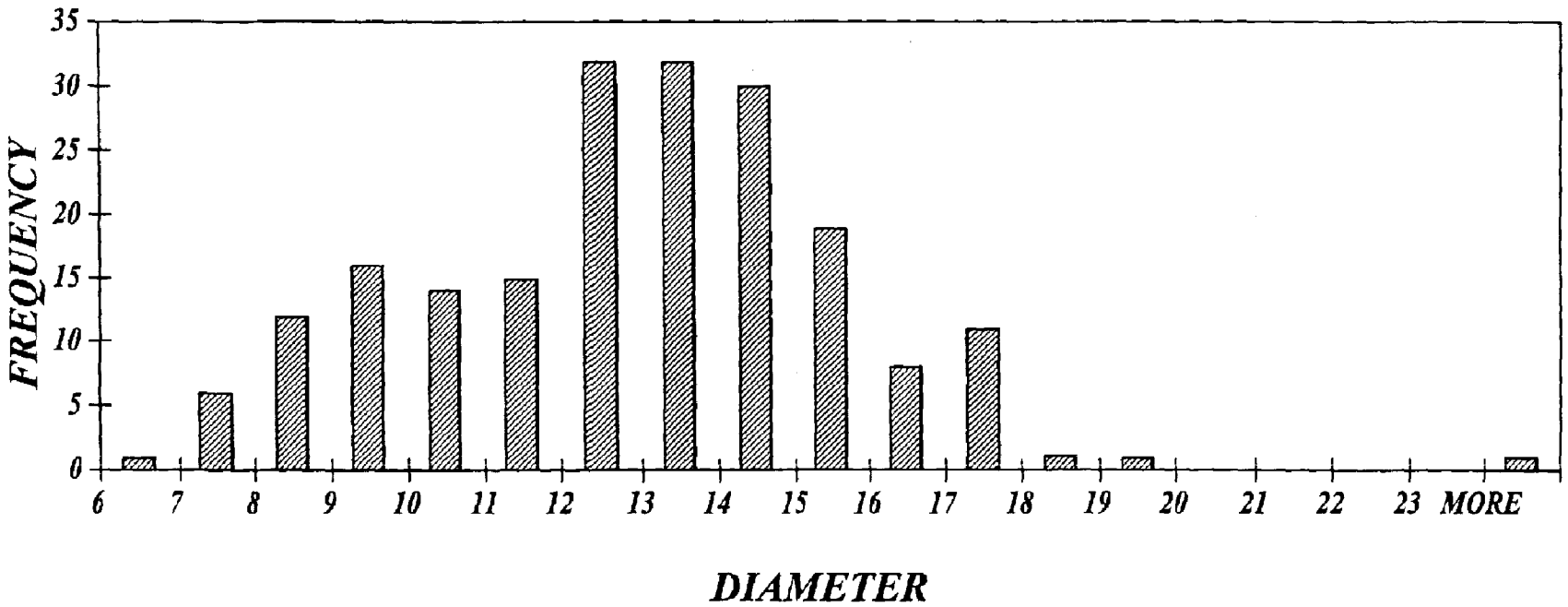
FIG. 11 is a graphical illustration of diameter distribution for meltblown lyocell fibers made from modified unbleached pulp according to the present invention.

Using the dry-jet wet spinning process, lyocell fibers produced from modified unbleached Kraft pulp having high hemicellulose and high lignin content were produced having the diameter distribution shown in FIG. 11. In one embodiment, the average diameter of a dry-jet wet lyocell fiber made from modified unbleached Kraft pulp is about 12 microns, and the fibers have denier of about 1.3.

Figure 12:
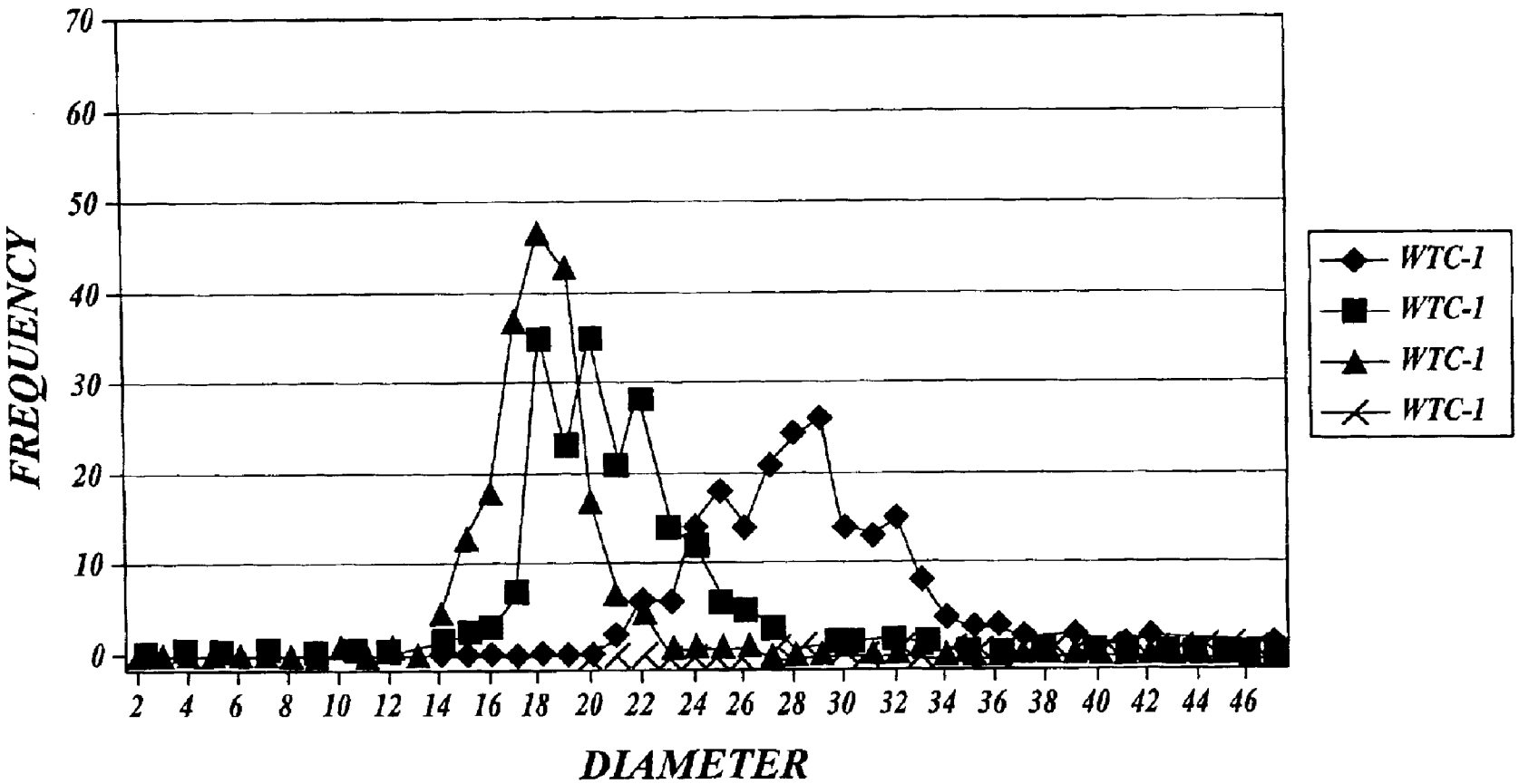
FIG. 12 is a graphical illustration of diameter distribution for dry-wet jet lyocell fibers made from modified unbleached pulp according to the present invention.

Using the meltblowing spinning method, lyocell fibers produced from modified unbleached Kraft pulp having high hemicellulose and high lignin content were produced having the diameter distribution shown in FIG. 12. Fiber diameter measurement was made using an optical microscope. About 200 fibers were randomly chosen from each sample for measurement. Average diameter and coefficient of variability were calculated. Coefficient of variability is described in U.S. Pat. No. 6,331,354, expressly incorporated herein by reference in its entirety.

A scanning electron microscope (SEM) or an optical microscope was used to observe the morphology of the fibers or the nonwoven web.

The mechanical properties of the fibers produced by the dry-jet wet method was measured with an Instron tester. Measurement of fiber bundles of 10 filaments was used to determine the average.

The following examples now merely illustrate the best mode now contemplated for practicing the invention, but should not be construed to limit the invention.

EXAMPLE 1

Dry-Jet Wet and Meltblown Spinning Process Conditions

Lyocell fibers were produced using laboratory process equipment from both the Thuringisches Institut Fur Textil Und Kunststoff-Forschung (TITK) and the Weyerhaeuser Technology Center (WTC). Table 1 illustrates some of the process conditions used for the dry-jet wet and meltblowing methods.

TABLE 1

| Basic condition | TITK lab process (DJW) | WTC lab process (DJW) | WTC meltblown |
|---|---|---|---|
| Nozzle diameter (micron) | 75–90 | 80 | 450 |
| Spinning temperature ° C. | 85–90 | 90–105 | 90–105 |
| Winder speed (m/m) | 70–100 | 60–100 | >200 |
| Bath temperature ° C. | 4–5 (water/ NMMO mixture) | 20–30 (water) | 20–30 (water) |

It was found that the average diameter of the TITK dry-jet wet lyocell fibers from modified unbleached Kraft is about 12 microns, and the fibers have a denier of about 1.3. The diameter distribution is shown in FIG. 11. As can be seen from FIG. 11, the diameter of the dry-jet wet lyocell fibers from the modified unbleached Kraft pulps had some variability. The variability may have contributed to tenacity variability as discussed below.

EXAMPLE 2

Mechanical Properties of the Dry-Jet Wet Lyocell Fibers

An Instron tester was used to measure the mechanical properties of the dry-jet wet lyocell fibers. The properties are shown in Table 2.

TABLE 2

| | Tensile at Max. Load (kgf) | Elongation at Max. Load (%) | Tensile Energy Absorption (J/m^2) | Tensile at Max. Load (kN/m) | MOE (GPa) | Width (mm) |
|---|---|---|---|---|---|---|
| | | 30 MM GAUGE LENGTH | | | | |
| | 0.048 | 7.44 | 2147 | 29.36 | 40.99 | 0.016 |
| | 0.028 | 8.58 | 1774 | 24.77 | 29.44 | 0.011 |
| | 0.029 | 5.86 | 1271 | 20.40 | 40.99 | 0.014 |
| | 0.055 | 9.32 | 3575 | 36.24 | 54.85 | 0.015 |
| | 0.030 | 4.21 | 1423 | 19.57 | 25.87 | 0.015 |
| | 0.034 | 5.46 | 1011 | 22.29 | 48.44 | 0.015 |
| | 0.052 | 104.20 | 976 | 33.96 | 49.65 | 0.015 |
| | 0.030 | 4.91 | 1193 | 22.68 | 53.38 | 0.013 |
| | 0.033 | 6.91 | 1952 | 29.07 | 99.27 | 0.011 |
| | 0.042 | 6.71 | 2076 | 37.69 | 126.30 | 0.011 |
| Mean: | 0.038 | 16.36 | 1740 | 27.60 | 56.92 | 0.014 |
| Std Dev: | 0.010 | 30.90 | 776 | 6.66 | 31.58 | 0.002 |
| COV: | 27.245 | 188.89 | 45 | 24.12 | 55.48 | 14.375 |
| | | 10 MM GAUGE LENGTH | | | | |
| | 0.083 | 12.82 | 7201 | 74.07 | 58.58 | 0.011 |
| | 0.097 | 9.58 | 7090 | 86.16 | 59.68 | 0.011 |

TABLE 2-continued

| | Tensile at Max. Load (kgf) | Elongation at Max. Load (%) | Tensile Energy Absorp-tion (J/m^2) | Tensile at Max. Load (kN/m) | MOE (GPa) | Width (mm) |
|---|---|---|---|---|---|---|
| | 0.047 | 8.72 | 4118 | 46.20 | 76.11 | 0.010 |
| | 0.065 | 11.07 | 5679 | 63.58 | 55.32 | 0.010 |
| | 0.053 | 9.11 | 4763 | 51.73 | 152.60 | 0.010 |
| | 0.044 | 9.24 | 34.86 | 42.78 | 41.82 | 0.010 |
| | 0.068 | 12.71 | 6298 | 66.73 | 24.52 | 0.010 |
| | 0.028 | 8.16 | 1042 | 21.16 | 29.46 | 0.013 |
| | 0.073 | 12.27 | 5664 | 50.96 | 39.81 | 0.014 |
| | 0.045 | 14.23 | 3591 | 29.31 | 9.06 | 0.015 |
| | 0.043 | 11.21 | 3557 | 46.80 | 28.44 | 0.009 |
| Mean: | 0.059 | 10.83 | 4772 | 52.68 | 52.31 | 0.011 |
| Std Dev: | 0.020 | 2.00 | 1846 | 19.01 | 38.38 | 0.002 |
| COV: | 34.665 | 18.46 | 39 | 36.08 | 73.37 | 17.350 |

The tenacity measurement of the fibers is reasonably reproducible considering that the equipment is normally used for paper testing. The tenacity is dependent on the gauge length.

The dry-jet wet lyocell fibers from the modified unbleached Kraft pulp have a dry tenacity of about 46 cN/tex at a gauge length of 10 mm. If a gauge length of 30 mm is used for testing, the dry tenacity for the lyocell fibers is 30 cN/dtex.

A decrease in tenacity with increasing gauge length is typical. The result, nevertheless, indicates the potential to produce strong lyocell fibers from modified unbleached Kraft pulps. For example, TITK uses 10 mm gauge length for their testing and usually gives a tenacity of about 35 to 45 cN/tex for dry-jet wet lyocell from bleached pulp.

EXAMPLE 3

Diameter and Lignin Content of Meltblown Lyocell Fiber from Modified Unbleached Pulp Using the meltblown spinning system from WTC, lyocell fibers from modified unbleached Kraft pulp were obtained. The meltblown lyocell fiber had 3.4% of Klason lignin and the diameter results are summarized in Table 3.

TABLE 3

| Sample | WTC-1 | WTC-2 | WTC-3 | WTC-4 |
|---|---|---|---|---|
| Pulp | Acid hydrolyzed unbleached Kraft pulp | | | |
| Throughout/hole (g/m) | 2.0 | 1.0 | 0.50 | 0.25 |
| Average diameter (micron) | 28.24 | 20.17 | 17.62 | 11.84 |
| Standard deviation (micron) | 4.86 | 2.88 | 2.37 | 1.65 |
| COV (%) | 0.17 | 0.14 | 0.13 | 0.14 |
| Klason Lignin (%) | | | | 3.4 |

As expected, the diameter of the lyocell fiber decreased with decreasing throughput. The diameter will also be affected by air pressure, temperature, and winder speed, etc. For meltblown lyocell fibers, diameter distribution is usually broader than those from dry-jet wet process. FIG. 12 shows the diameter distribution of meltblown lyocell fiber from modified unbleached Kraft pulp. As can be seen from FIG. 12, meltblown lyocell fibers with lower average diameter had narrower diameter distribution, which is close to that of the dry-jet wet lyocell fibers shown in FIG. 11. Microfibers were produced having a diameter of about 8 microns. Adjusting the process conditions can produce smaller microfibers. Microfibers have the advantage of providing high coverage for various applications.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. An unbleached pulp, comprising:

at least 7% hemicellulose;

at least 2% Klason lignin; and cellulose, wherein greater than 95% of the cellulose has an average D.P. of greater than 400 to 1100.

* * * * *